US005473866A

United States Patent [19]

Maglecic et al.

[11] Patent Number: 5,473,866

[45] Date of Patent: Dec. 12, 1995

[54] VACUUM PACKMACHINE FOR FRENCH FRIES

[75] Inventors: Steven C. Maglecic, Meridian; Terry V. Kolk, Middleton; David M. Bartylla, Boise, all of Id.

[73] Assignee: J. R. Simplot Company, a Nevada corporation, Boise, Id.

[21] Appl. No.: 265,508

[22] Filed: Jun. 24, 1994

Related U.S. Application Data

[63] Continuation of Ser. No. 990,346, Dec. 14, 1992, abandoned.

[51] Int. Cl.[6] ..... B65B 1/22; B65B 9/08; B65B 19/00; B65B 31/04

[52] U.S. Cl. ..... 53/511; 53/151; 53/525; 53/544; 53/552

[58] Field of Search ..... 53/151, 154, 148, 53/511, 512, 525, 551, 552, 544, 236, 284.7, 374.8, 502, 155, 238

[56] References Cited

U.S. PATENT DOCUMENTS

| | | | |
|---|---|---|---|
| 1,047,984 | 12/1912 | Phifer . | |
| 2,432,373 | 12/1947 | Bleam et al. | 53/511 X |
| 2,549,322 | 4/1951 | McKinsey . | |
| 2,859,796 | 11/1958 | Taunton | 53/374.8 X |
| 2,969,627 | 1/1961 | Leasure . | |
| 3,473,287 | 10/1969 | Littwin | 53/236 X |
| 3,579,945 | 5/1971 | Buchner | 53/511 |
| 3,842,569 | 10/1974 | McClelland et al. . | |
| 3,861,121 | 1/1975 | Monsees . | |
| 4,004,398 | 1/1977 | Larsson et al. | 53/511 |
| 4,073,121 | 2/1978 | Greenawalt et al. | 53/511 |
| 4,084,123 | 6/1978 | Carlson . | |
| 4,096,938 | 6/1978 | Payne . | |
| 4,145,123 | 3/1979 | Cottrell . | |
| 4,159,610 | 7/1979 | Langen | 53/525 |
| 4,351,141 | 9/1982 | Glorfield et al. . | |
| 4,514,959 | 5/1985 | Shroyer . | |
| 4,519,179 | 5/1985 | Meier . | |
| 4,548,286 | 10/1985 | Sashiki et al. | 53/502 X |
| 4,586,313 | 5/1986 | Maglecic . | |
| 4,607,478 | 8/1986 | Maglecic . | |
| 4,718,217 | 1/1988 | Ross . | |
| 4,813,205 | 3/1989 | Mikata et al. | 53/502 X |
| 4,825,623 | 5/1989 | Ross . | |
| 4,827,697 | 5/1989 | Ross . | |
| 4,843,795 | 7/1989 | Shroyer . | |
| 4,965,986 | 10/1990 | Klinkel | 53/551 |
| 5,038,550 | 8/1991 | Wirsig et al. | 53/551 X |

*Primary Examiner*—Linda Johnson
*Attorney, Agent, or Firm*—Kelly Bauersfeld & Lowry

[57] ABSTRACT

An improved packaging machine is provided for vacuum packing elongated products such as french fries into a succession of sealed bags. The packaging machine includes a weigh station for dropping pre-weighed product charges through a vertical column for product free-fall into a bag at a fill station, with the bag being formed from a sheet of film material drawn downwardly about the column. A divider vane subdivides the vertical column and the fill station into a pair of passages of elongated cross section, whereby the products falling through the column passages are substantially aligned as they fall into the bag. The bag is transferred from the fill station to a settling station, preferably by displacement of the divider vane and fill station. The settling station includes vibratory members to achieve substantial product settling. The bag film material may also be retracted a short stroke through a seal jaw assembly, resulting in stripping and squaring of an open end of the bag. A vacuum is drawn within the bag via vacuum ports formed in the divider vane. The seal jaw assembly then seals the top of the filled bag as well as the bottom of the next bag in succession, and severs the filled bag from the film material. An improved stream-out chute and distribution funnel are also disclosed for delivering the products from the weigh station to the vertical column with product distribution which is substantially uniform across the open area of the free-fall column passages.

49 Claims, 10 Drawing Sheets

VERTICAL ACTUATOR
78
46
46
28
60
60
66
66
62
83
84
VACUUM SUPPLY
GAS FLUSH
85
80
20
16
17
56
CONTROLLER
34
30
120
ACTUATOR
38
32
17
ACTUATORS
88
36
36
40
18
24
14A
BLADE SWITCH
ACTUATORS
SEALER SWITCH
109
14B
94
DRIVE MOTOR
10
104
22
97
126
AIR SUPPLY
14
12
127

FIG. 3
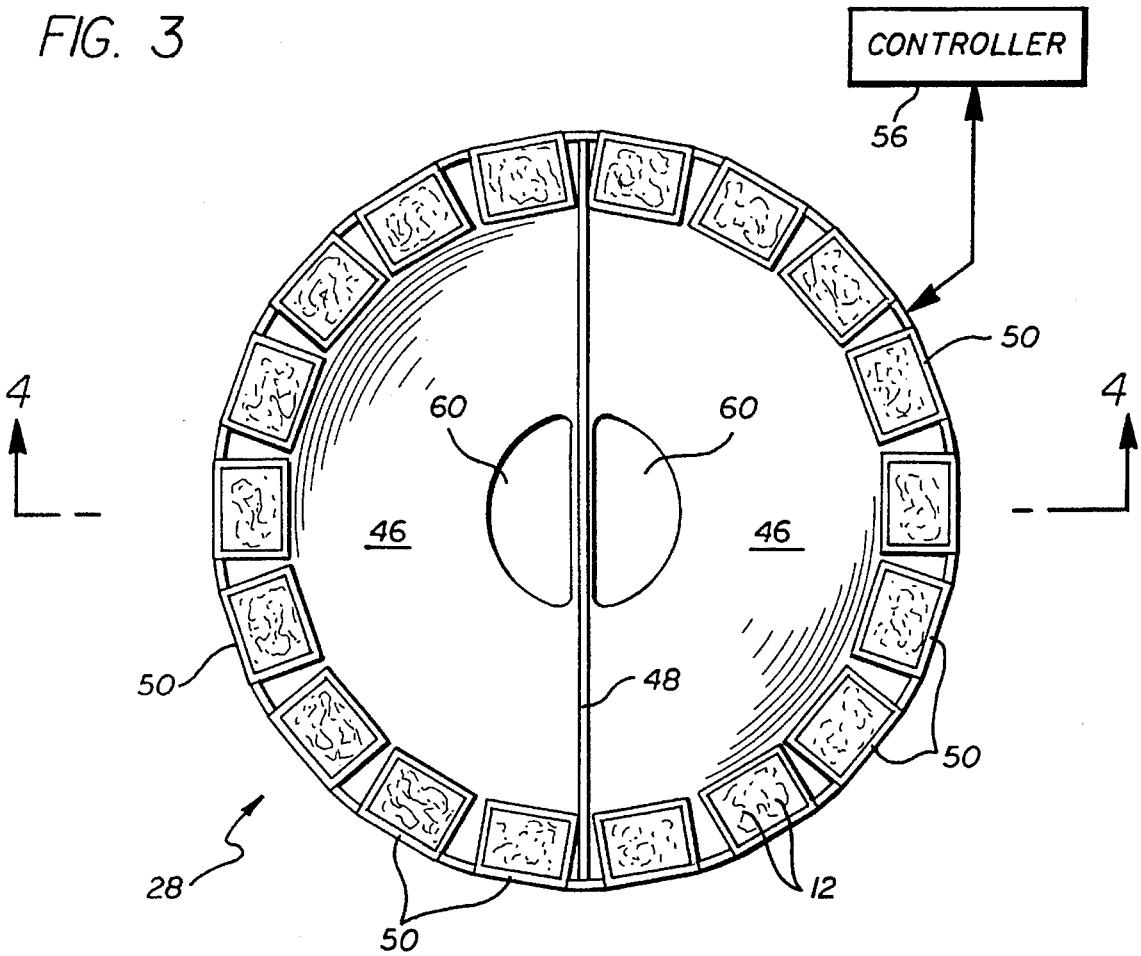
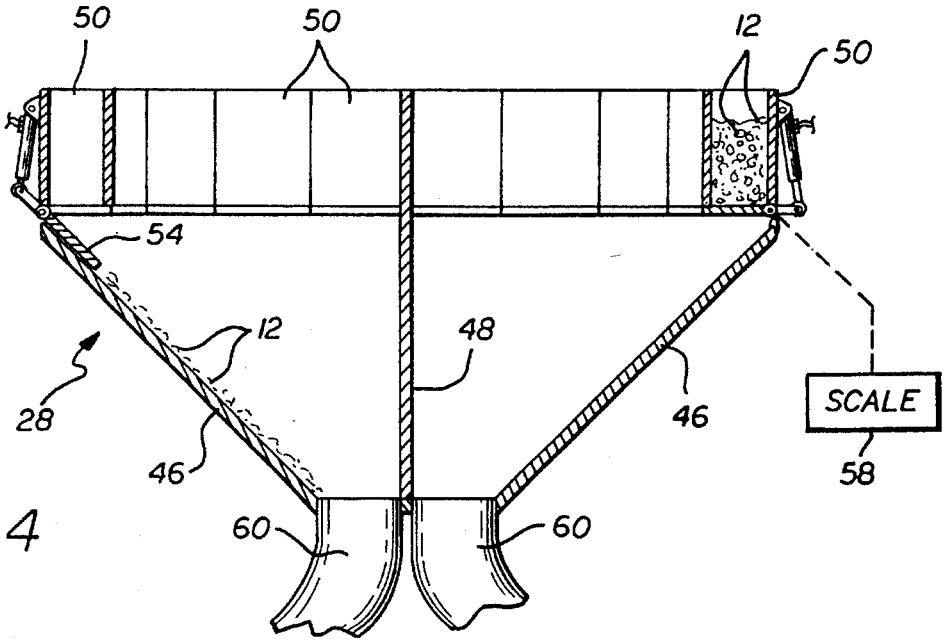
FIG. 4

FIG. 5
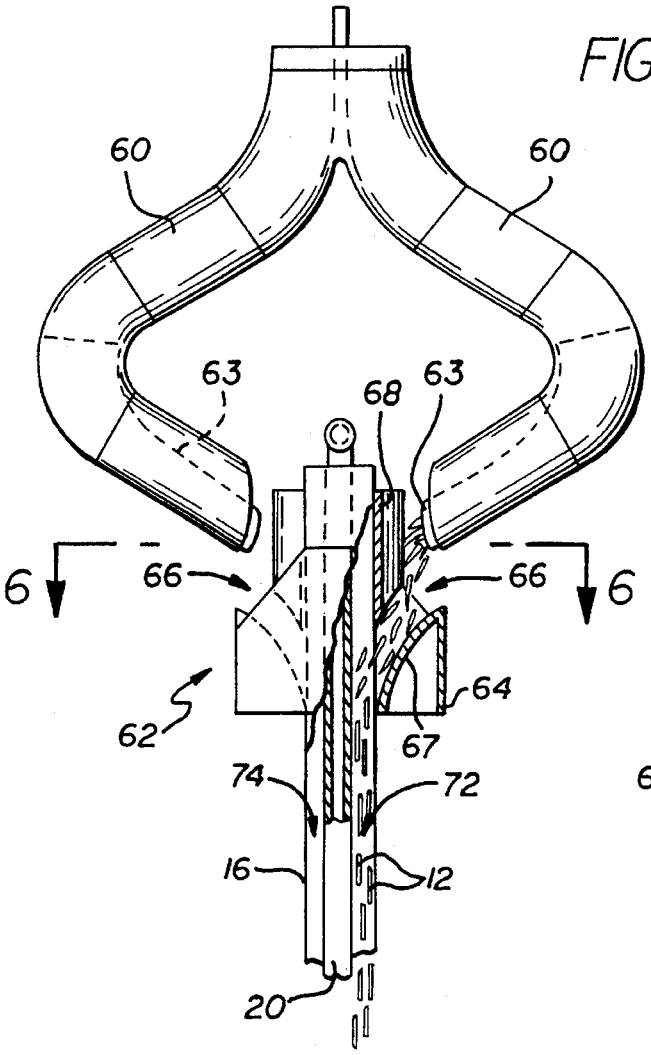
FIG. 7
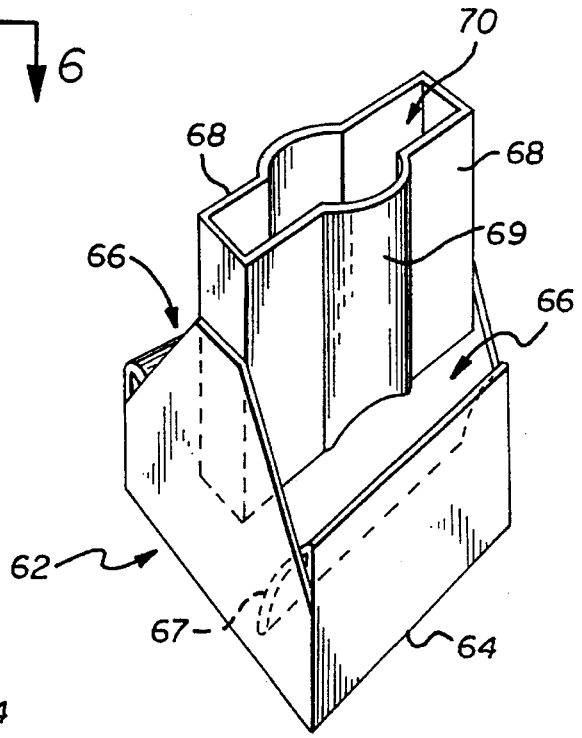
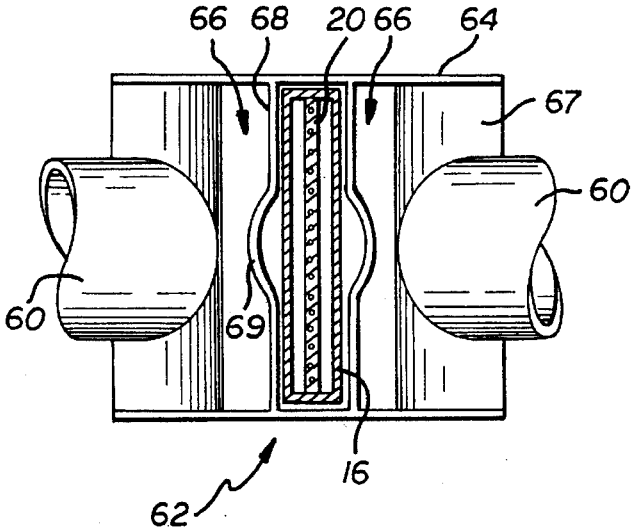
FIG. 6

FIG. 12
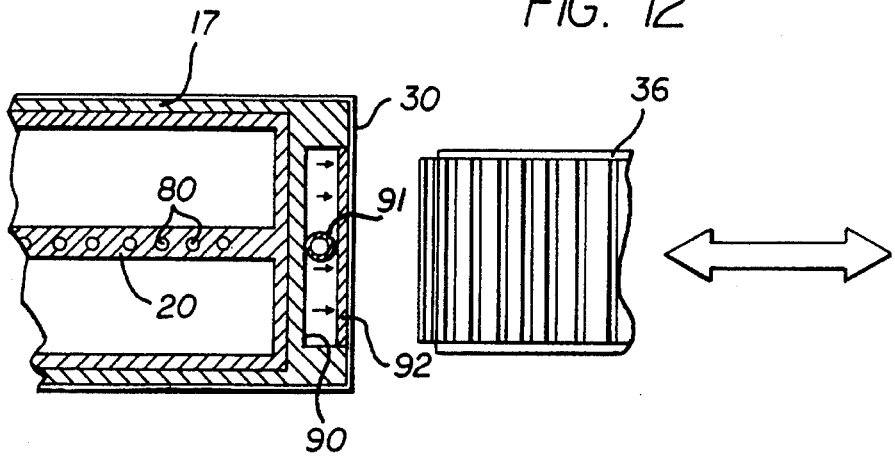
FIG. 14
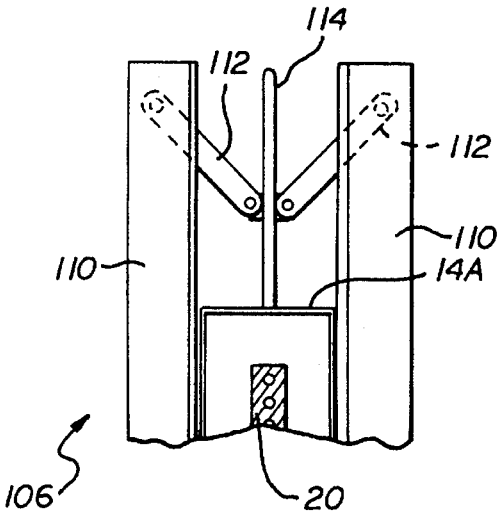
FIG. 17
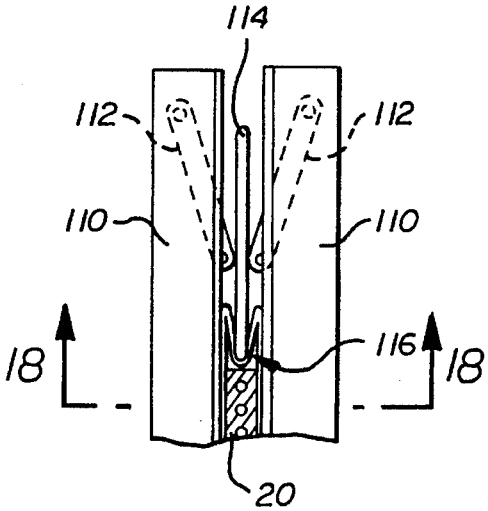
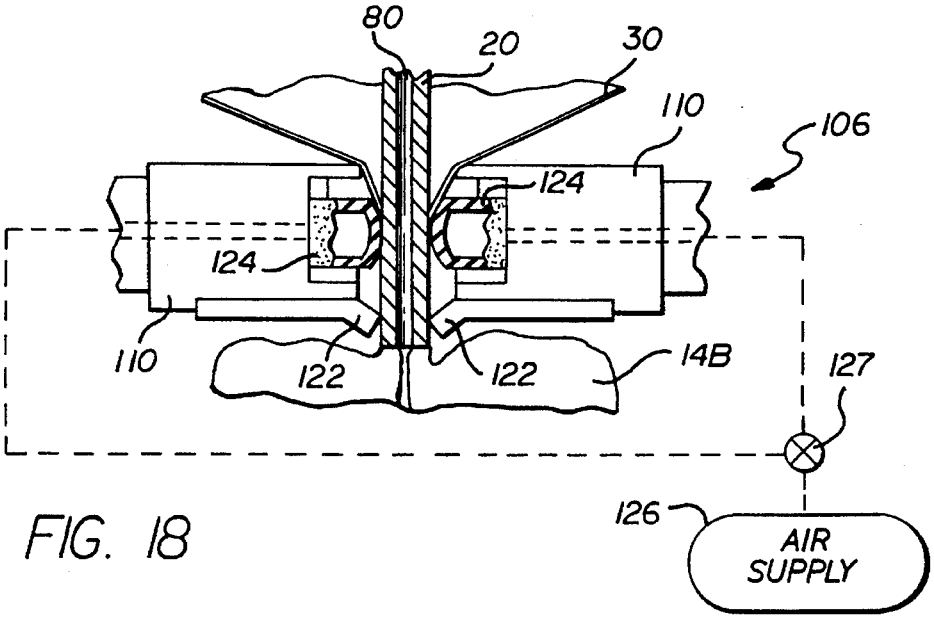
FIG. 18

VACUUM PACKMACHINE FOR FRENCH FRIES

This application is a continuation of application Ser. No. 07/990,346, filed Dec. 14, 1992, now abandoned.

BACKGROUND OF THE INVENTION

This invention relates generally to an improved packaging machine and method for packaging elongated products particularly such as french fries. More specifically, this invention relates to a packaging machine for vacuum packing of french fries in a succession of sealed bags, wherein the french fries are arranged in substantial alignment to provide a substantially maximized product bulk density.

Automated packaging machines and systems are generally known in the art for filling cartons and bags and the like with products. For example, in the foods industry, it is well-known to process a particular food item in bulk quantities and then to convey the processed item to appropriate packaging equipment for automated package filling. It is highly desirable, of course, to maximize the quantity of the product contained in each individual package, or, alternately stated, it is desirable to minimize the size of the package per unit weight so that package costs can be minimized while achieving maximum use of shipping and/or warehousing space. With some items, however, such as parfried and frozen french fry potato strips, the elongated product configuration has typically resulted in product packaging in a random or jackstrawed orientation which does not maximize the package bulk density. As a result, substantial product breakage often occurs as multiple product packages are handled for placement within a larger shipping case. Moreover, product settling tends to occur during shipment and/or storage, often resulting in collapsing of stacked or palletized shipping cases and further product breakage. Such product breakage has a strong negative impact on product quality. In addition, the inability to maximize product bulk density inherently increases product shipping cost and related cost of the product to the ultimate consumer.

In the past, a variety of packaging systems and processes have been proposed particularly for use with parfried frozen french fries in an effort to increase the product bulk density within each package. In this regard, various vibratory and/or gravity free-fall systems have been suggested in attempts to align french fry strips within cardboard or paperboard boxes which are sized for group placement in turn within conventional corrugated shipping cases. See, for example, U.S. Pat. No. 4,351,141. Alternately, related packaging systems have been developed in efforts to align french fries for delivery into a succession of sealed bags formed from a suitable kraft-based paper or plastic packaging material. See, for example, U.S. Pat. Nos. 4,514,959; 4,586,313; 4,843,795; and 4,607,478.

While the various french fry alignment packaging systems of the type referenced above may provide some improvements in product bulk density, significant volumetric inefficiency and unused packaging space still occurs. For example, when the french fry strips are packaged in paperboard cartons, the carton defines the volumetric size of the shipping container, with significant product settling occurring to result in substantial unoccupied package volume. By contrast, when the product is packaged within sealed flexible bags, a significant proportion of product alignment is lost during handling of the flexible bags for subsequent packing within substantially rigid cardboard shipping cases. As a result, when the bags are finally packaged in the shipping case, the bagged product is subject to significant settling and breakage attributable thereto.

There exists, therefore, a significant need for further improvements in packaging machines and methods for packing elongated products such as parfried frozen french fries and the like, in a manner which substantially maximizes the bulk density of the product within a shipping package, and thereby significantly reduces product settling and resultant breakage while making maximum use of available warehouse and/or shipping volumetric space. The present invention fulfills these needs and provides further related advantages.

SUMMARY OF THE INVENTION

In accordance with the invention, an improved packaging machine and method are provided for vacuum packing of elongated products such as french fries in a succession of bags, wherein the french fries are substantially aligned within each bag to achieve substantially maximum product bulk density. The aligned french fries are maintained within the vacuum bag in a substantially rigid configuration during packing of multiple bags into shipping cases, and during subsequent shipping and handling, thereby substantially reducing or eliminating product settling and related product breakage attributable thereto. Moreover, by appropriate selection of the bag material, the vacuum packed products are effectively shielded from contact with ambient moisture, thereby preventing or minimizing frost build-up during storage and/or shipment.

The packaging machine comprises an elongated vertical column through which pre-weighed product charges are dropped to free-fall into a bag disposed at a fill station located at the lower end of the vertical column. The bag is formed from a continuous sheet of film material fed over a contoured shroud or forming shoulder for downward displacement about the vertical column, with a longitudinal seam formed to define a closed loop cross or tubular sectional shape. A pull-down mechanism transfers each bag in succession from the fill station to a settling station which includes vibratory drive means to achieve further increase in product bulk density. Vacuum means draws a vacuum within the filled bag, and a seal jaw assembly seals the top of the evacuated bag in addition to the bottom of the next bag in succession. In the preferred form, the forming shoulder draws upwardly on the bag in advance of the vacuum draw step, whereby the top of the filled bag is pulled through the seal jaw assembly for purposes of squaring off the bag shape and to strip stray product from the region of the bag seal. When the vacuum is drawn and the bag is sealed, knife means severs the filled bag for delivery from the settling station and further packaging, for example, in a cardboard shipping case or the like.

The pre-weighed product charges are delivered to the upper end of the vertical column by a weigh station. In the preferred form, each product charge is supplied in the form of substantially equal half-charges delivered to the vertical column at opposite sides of a divider vane which subdivides the vertical column into a pair of passages of elongated cross-sectional shape. These elongated passages thus have a relatively long passage length and comparatively narrow passage width, in a horizontal plane, to contribute to efficient alignment of the french fry strips generally in parallel with the long or length dimension of the associated column passage. The products free-fall through the column passages and thus fill the bag at the fill station on opposite sides of the divider vane.

The vertical column defines the fill station at the lowermost end of the column, wherein the fill station comprises a generally rectangular structure forming a product fill chamber having a size and shape approximating the desired shape of each filled bag. The divider vane extends through the vertical column, and further through the fill chamber to subdivide the interior thereof into the pair of narrow width, elongated length passages. Each bag is transferred during filling thereof to the settling station by downward displacement of the divider vane and fill chamber, concurrently with downward advancement of the bag-forming film by operation of the pull-down mechanism. The divider vane and fill chamber are effectively and relatively withdrawn from the filled bag, as the bag is delivered to the settling station. Vacuum ports formed within the divider vane are connected to a suitable vacuum source for drawing the vacuum within the filled bag at the settling station. The seal jaw assembly clamps the upper portion of the filled bag against the divider vane during this vacuum draw step. When the vacuum is suitably drawn, the divider vane is withdrawn further from the seal jaw assembly, and the bag is appropriately sealed and cut, as previously described.

The weigh station, in the preferred form, comprises a plurality of weigh buckets adapted to receive selected charges of the elongated products. Control means are provided for delivering the products from selected combinations of the weigh buckets in substantially equal weight half-charges to a pair of spiral stream-out chutes mounted at opposite sides of the divider vane. The stream-out chutes are designed to include at least two vertically offset turns which stream out the charge flow for delivery to a corresponding pair of distribution funnels at substantially identical delivery points, irrespective of the specific weigh buckets dispensing the product. The distribution funnels, which may include curved deflector wall structures, spread the half-charges with substantial uniformity over the open areas of the column passages, such that the elongated strip products are delivered ultimately through the vertical column with substantial uniformity of distribution to the bag on opposite sides of the divider vane within the fill chamber.

In accordance with further aspects of the invention, the settling station includes means for receiving the filled bag and retaining the shape thereof during bag stripping, evacuation, sealing and cutting. The vibratory drive means at the settling station comprises a plurality of eccentrically driven rollers disposed on opposite sides of a settling chamber to assist in drawing the filled bag downwardly to the settling station, while achieving further settling of the aligned products prior to bag sealing. A discharge passage at the lower end of the settling chamber may include a reciprocally driven vibrator plate for squaring off the bottom of the filled bag while achieving still further product settling. The vibrator plate is displaced to an open position to permit downward bag discharge subsequent to sealing and cutting.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 3 is an enlarged fragmented top plan view of the machine shown in FIG. 1, illustrating a product weigh station including a plurality of weigh buckets;

FIG. 4 is a fragmented vertical sectional view taken generally on the line 4—4 of FIG. 3;

FIG. 5 is an enlarged fragmented side elevational view, shown partially in vertical section, illustrating spiral stream-out chutes and a distribution funnel for delivering product charges to the vertical free-fall column;

FIG. 6 is a fragmented horizontal sectional view taken generally on the line 6—6 of FIG. 5;

FIG. 7 is a perspective view illustrating further details of a preferred construction for the distribution funnel;

FIG. 12 is an enlarged fragmented horizontal sectional view taken generally on the line 12—12 of FIG. 2;

FIG. 14 is a fragmented horizontal sectional view taken generally on the line 14—14 of FIG. 13, and illustrating a gusset blade in a retracted position;

FIG. 17 is an enlarged fragmented horizontal sectional view taken generally on the line 17—17 of FIG. 15;

FIG. 18 is a fragmented vertical sectional view, shown somewhat in schematic form, taken generally on the line 18—18 of FIG. 17;

DETAILED DESCRIPTION OF THE PREFERRED EMBODIMENT

Figure 1:
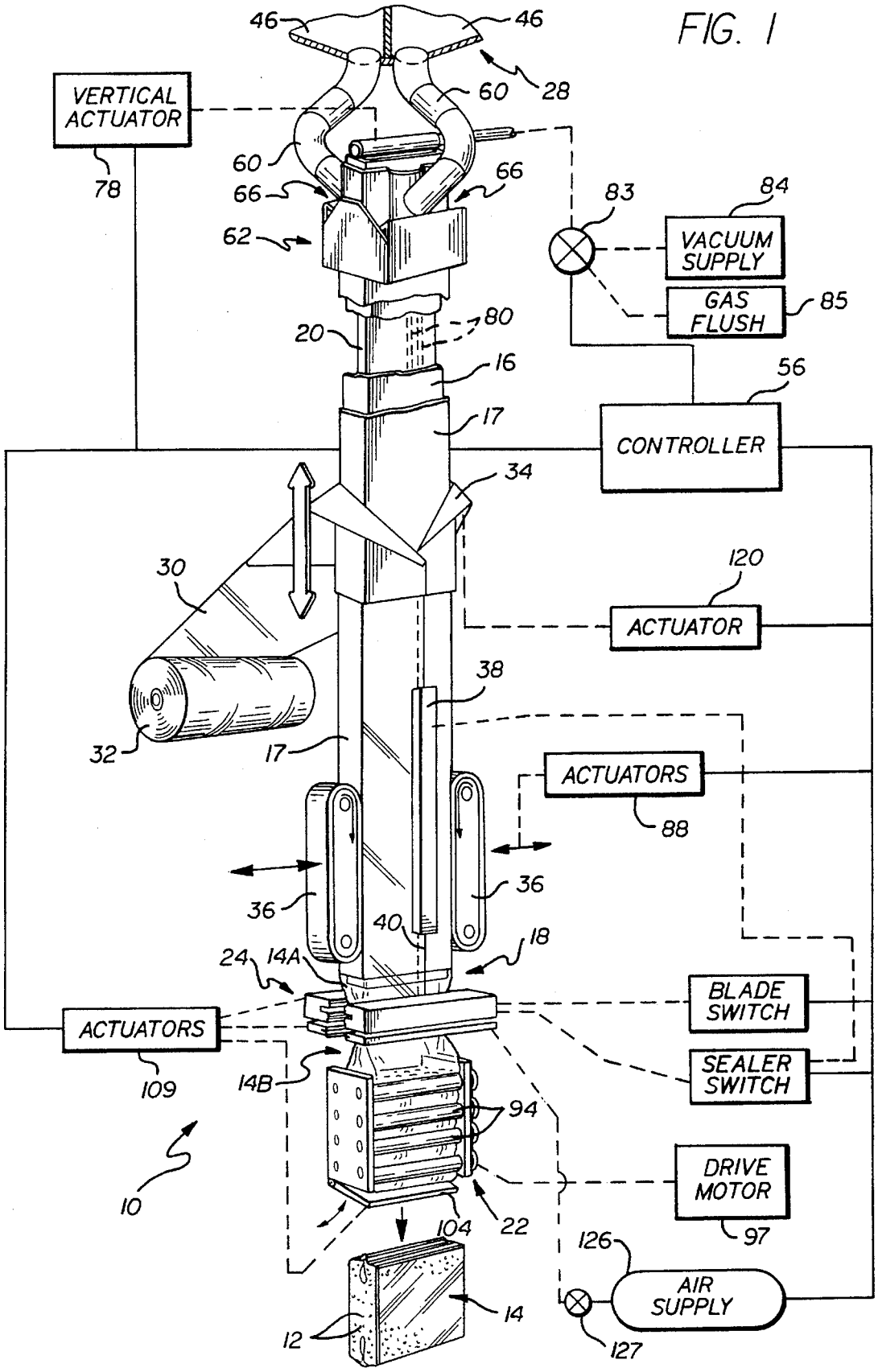
FIG. 1 is an exploded perspective and somewhat schematic view illustrating an improved vacuum pack machine embodying the novel features of the invention.

As shown in the exemplary drawings, a packaging machine referred to generally in FIG. 1 by the reference numeral 10 is provided for packaging elongated products such as parfried frozen french fry strips 12 in a succession of vacuum sealed bags 14. The packaging machine 10 delivers pre-weighed charges of the french fry strips to a vertical free-fall column 16 through which the french fry strips fall into a partially formed bag at a fill station 18, wherein the partially formed bag is conveniently identified by reference numeral 14A. A central divider vane 20 extends through the vertical column 16 and cooperates therewith to insure substantial french fry strip alignment within the bag 14A, thereby substantially maximizing the product bulk density within each bag. The filled bags are transported in succession to a settling station 22 whereat a vacuum is drawn and the bag is sealed to provide a substantially rigid vacuum packed structure for subsequent product shipment and/or storage.

Figure 21:
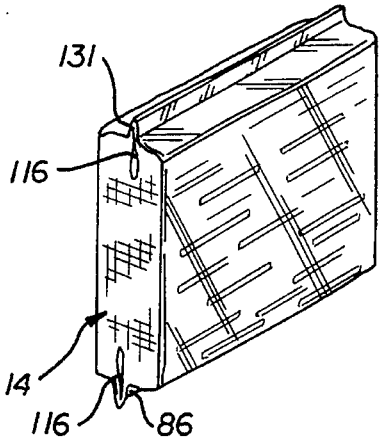
FIG. 21 is a perspective view illustrating a vacuum packed bag produced by the packaging machine.

The improved packaging machine 10 of the present invention is designed for packaging a wide variety of elongated articles, particularly such as parfried and frozen french fry potato strips or other food products, into a succession of the vacuum sealed bags 14. The machine 10 delivers pre-weighed charges of the elongated products in a manner resulting in substantial product alignment within each filled bag, thereby achieving a substantially optimized package bulk density and related optimized use of available product storage and/or shipping volumes. Each filled bag is transported in succession to the settling station 22, which preferably includes vibratory settling means for further increasing the bulk density of the product within the package. In the preferred form, stripper means are also provided for squaring off and substantially eliminating residual space at the top of each bag, prior to sealing and cutting by means of a seal jaw assembly 24. Each vacuum sealed bag 14 has a substantially rigid configuration attributable to the vacuum drawn therein (FIG. 21), in combination with a substantially uniform size and shape conducive to efficient use of shipping space, for example, by packing a preselected number of the vacuum sealed bags 14 within a larger shipping case 26 (FIG. 22) of paperboard or the like. This shipping case 26 may be designed in turn to have a size and shape to optimize available storage and shipping space, such as by providing an optimally sized pallet or shipping case sized to make maximum use of standard truck and/or rail car volumes.

Figure 2:
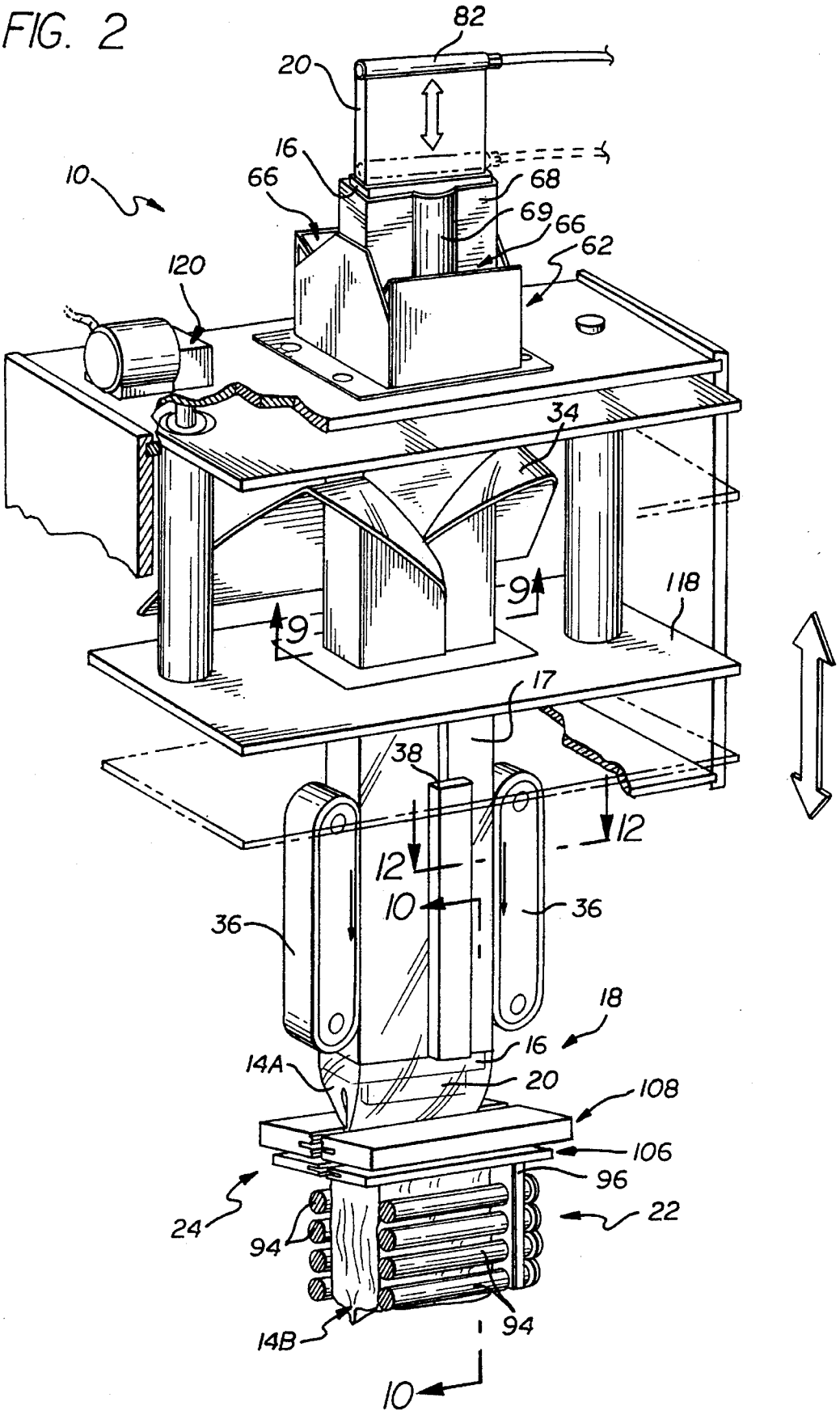
FIG. 2 is an enlarged fragmented perspective view of a portion of the machine, illustrating construction details of a vertical free-fall column.

As shown generally in FIGS. 1 and 2, the vertical free-fall column 16 has a length extending substantially without interruption between an overhead weigh station 28 and the fill station 18 disposed at the lowermost end of said column. The weigh station 28 is adapted, as will be described in more detail, to deliver product charges in precision weighed amounts to the upper end of the vertical column 16. The product free-falls through the column 16 to the lower end thereof for deposit into a partially formed and upwardly open bag 14A at the fill station 18. In accordance with one aspect of the invention, the vertical dimension of the column 16 is sufficient to achieve substantial alignment of the product falling into the bag 14A, with a preferred column height being on the order of about three to four feet. A minimum column height for purposes of achieving significant product strip alignment within the bags 14A is believed to be on the order of one and one-half to two feet.

The partially formed bag 14A at the fill station 18 is defined by a sheet of air impervious packaging film material 30, such as plastic polyethylene film, obtained from a roll 32 supported at one side of the vertical column 16 by suitable roll support and tension control means (not shown), such as that described in U.S. Pat. No. 2,969,627 which is incorporated by reference herein. The film material 30 is fed over a contoured shroud or forming shoulder 34 adapted to wrap the film material into a closed loop or tubular cross sectional shape about an outer tube or guide sleeve 17 which in turn surrounds the column 16. In this regard, the vertical column 16 and the surrounding outer guide sleeve 17 are shown to have a generally rectangular cross sectional shape, preferably on the order of approximately three inches by twelve inches. A film pull-down mechanism including a pair of drive belt units 36 is provided to engage the film material extending downwardly about the column 16 and sleeve 17 for purposes of drawing the film material intermittently to the fill station 18. A vertically elongated heat seal unit 38 overlies the overlapping side margins or edges of the film material 30 and functions to form a continuous longitudinal seam 40, thereby forming the film material into the desired closed loop configuration.

The fill station 18 is disposed at the lower end of the vertical column 16, in close proximity above the seal jaw assembly 24. The seal jaw assembly includes means for closing and sealing the film material 30 at a location disposed a short distance below the vertical column 16, thereby defining a sealed lower end for each partially formed bag 14A at the fill station. The rectangular column 16 generally corresponds with the desired rectangular shape of the final vacuum sealed bag, and thus functions to configure and retain the film material in the desired approximate bag shape during bag filling as the product charges free-fall through the column 16 into the upwardly open bag at the fill station. When or as the bag is filled with aligned free-falling product, the drive belt units 36 advance the bag through the seal jaw assembly 24 to the settling station 22. At the settling station 22, for ease of identification, the partially formed and filled bag is referred to by reference numeral 14B.

At the settling station 22, a vacuum is drawn within the filled bag 14B, in a manner to be described in detail, followed by actuation of the seal jaw assembly 24 to close and seal the upper end of the filled bag. At the same time, the lower end of the next bag 14A in succession disposed at the overlying fill station 18 is also closed and sealed by the seal jaw assembly 24. The vacuum packed bag 14B at the settling station 22 is severed from the overlying bag 14A at the fill station 18, thereby permitting the severed bag 14 to be discharged from the machine 10 for subsequent handling and packaging, such as by packing a plurality of the vacuum sealed bags 14 in the paperboard shipping box or case 26, as viewed in FIG. 22. Importantly, as shown best in FIG. 21, each vacuum sealed bag 14 has a substantially rigid construction attributable to the bag vacuum which retains the aligned products in tight-fitting array of a substantially maximized product bulk density. In particular, for a standard package of parfried and frozen french fry strips 12 having a weight of about six pounds, the packaging machine 10 of the present invention provides a reduction in package volumetric size of up to thirty percent. Subsequent handling of the vacuum sealed bag does not result in bag deformation or jumbling of the products therein. To the contrary, the rigid vacuum sealed bag effectively protects the products against relative settling and breakage during post-pack handling. Moreover, a succession of the vacuum packed bags beneficially have a highly consistent size and shape, so that they can be fitted snugly into the shipping case 26 which has an optimally compact size and shape. Still further, the plastic film bag may be a recyclable material which protects the products from freezer frost or frost build-up within the bag, while additionally providing a transparent bag permitting the packed products to be viewed for purposes of visual quality inspection without opening the bag.

The weigh station 28 is shown in more detail, in one preferred form, in FIGS. 3 and 4. As shown, the illustrative weigh station 28 comprises a pair of generally semicircular funnel-shaped receivers 46 disposed face-to-face with a common divider wall 48 disposed therebetween. These semicircular receivers 46 are each associated with a corresponding semicircular array of individual weigh buckets 50 adapted to receive french fry strips 12 or the like transported to the weigh buckets by product conveyors (not shown) or other suitable means. The weigh buckets 50 each include a lower gate 54 (FIG. 4) adapted for pivoting motion between open and closed positions in response to a controller 56 (FIG. 3). The bucket gates 54 are each associated with a scale 58 (FIG. 4) which provides the controller 56 with a signal representative of the mass quantity of product within each weigh bucket. The controller 56 operates the gates 54 associated with one or multiple weigh buckets 50 in a manner insuring delivery of precision weighed product charges to the dual receivers 46. As will be described, the quantity of the product delivered to each receiver 46 constitutes a half-charge for free-fall passage through the column 16 into the bag 14A at the fill station 18. In a typical french fry packing installation, by way of example, the bucket gates 54 are appropriately opened to deliver a product half-charge of about three pounds to each receiver, resulting in a total product charge of about six pounds to each bag 14A.

The product half-charges delivered to the semicircular receivers 46 fall into the upper ends of a corresponding pair of stream-out chutes 60 of generally spiral shape. These stream-out chutes, as depicted in FIGS. 1 and 5, comprise tubular conduits which extend generally in a downward direction from the receivers 46 to a distribution funnel 62 at the upper end of the vertical column 16. Each stream-out chute 60 has a cross sectional size sufficient to prevent jamming of the product charges therein, with a diametric size adequate for normal french fry packing uses. In accordance with one aspect of the invention, each stream-out chute 60 has an offset configuration defining at least two vertically offset or vertically misaligned turns extending through an angle of about 45 degrees or more, and terminating in a chute discharge end which is aimed downwardly and inwardly toward the associated distribution funnel 62 at an angle of about 45 degrees. In operation, the stream-out chutes 60 function to spread the product half-charges in a longitudinally extended stream, thereby substantially preventing jackstrawed clumps or clusters of the products as they are delivered to the vertical free-fall column 16. Meridional divider walls 63 (FIG. 5) are preferably installed to extend over a downstream end portion of each chute 60 to assist in controlled aim delivery of the falling products to the distribution funnel 62.

The distribution funnel 62 is shown in a preferred configuration in FIGS. 5–7. As shown, the distribution funnel 62 comprises a vertically open housing 64 defining a pair of generally rectangular and vertically open passages 66 for respective guided flow of the product half-charges into the upper end of the column 16. Each of these passages 66 has an inboard side defined by a vertically extending deflector wall 68, and an outward side defined by a downturned convexly curved guide wall 67. The deflector walls 68 associated with the passages 66 in turn cooperatively form a central opening 70 therebetween through which the vertical column 16 passes. The central divider vane 20, as will be described in more detail, subdivides the interior of the column 16 into a pair of column passages 72 and 74 (FIG. 5) of elongated cross sectional shape, and relatively narrow width. Importantly, the generally rectangular shape of the funnel passages 66 approximates the rectangular shape of the column passages 72 and 74, which in turn approximate the rectangular cross sectional size and shape of the bag 14 to be filled and sealed.

In operation, the product half-charges exiting the stream-out chutes 60 flow respectively against the deflector walls 68 of the funnel 62 for downward deflection through the funnel passages 66 and into the column passages 72, 74 on opposite sides of the divider vane 20. As shown best in FIG. 7, in the preferred form, the deflector walls 68 preferably include convexly curved central segments 69 which cooperate with the associated curved guide walls 67 to spread the product half-charges with substantial uniformity over the entire cross-sectional areas of the underlying column passages 72, 74. With this arrangement, the falling product is delivered to the partially formed bag 14A at the fill station 18, with substantial uniformity of distribution across the open area of the bag. The column passages 72, 74 preferably have a substantially identical cross sectional size and shape, with the long dimensions of the passages in a horizontal plane being oriented generally in parallel with each other. The divider vane 20 defines a common wall separating the column passages.

Figure 8:
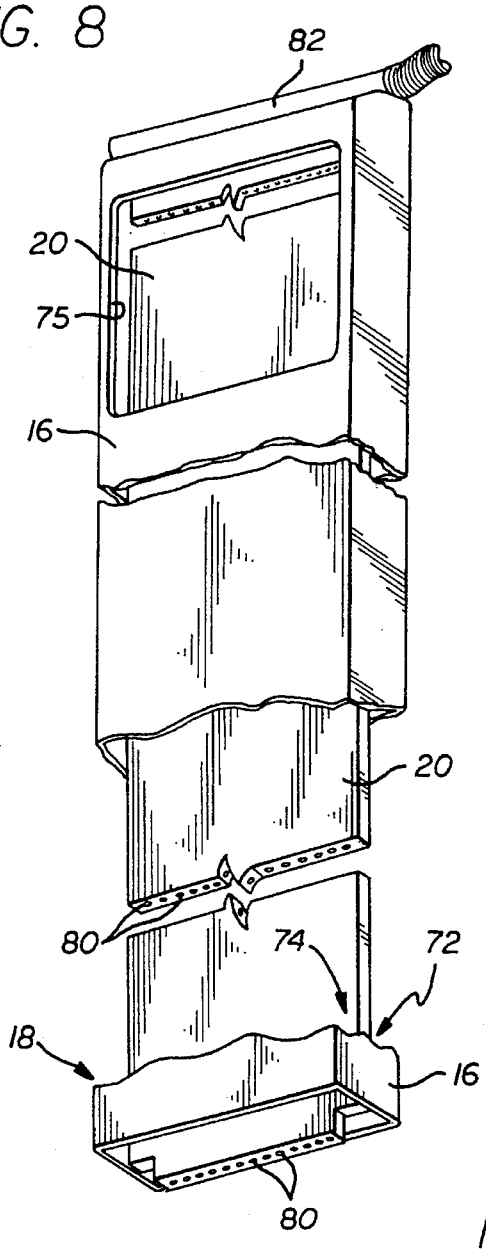
FIG. 8 is a fragmented perspective view illustrating a divider vane mounted within the vertical column.
Figure 9:
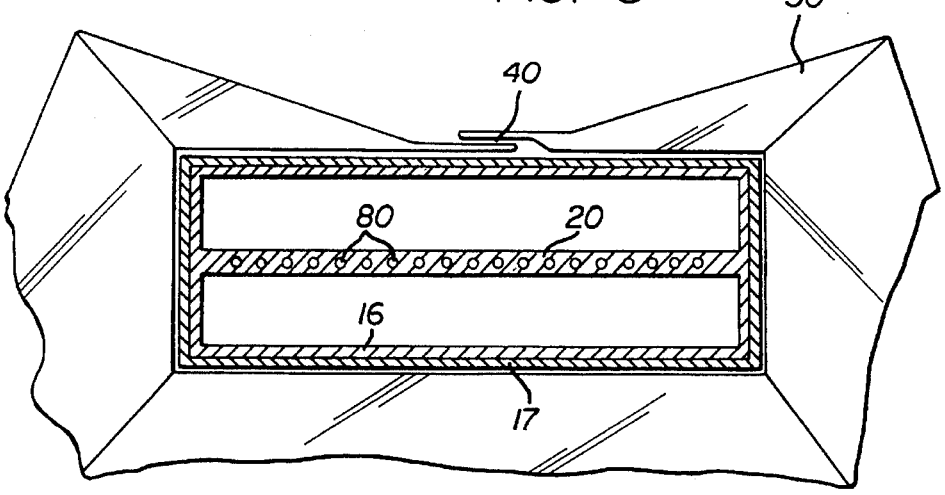
FIG. 9 is an enlarged horizontal sectional view taken generally on the line 9—9 of FIG. 2.

The divider vane 20 extends vertically through the column 16 to the fill station 18. In this regard, the preferred construction for the divider vane 20 and free-fall column 16 is shown in FIGS. 6, 8 and 9 to comprise an integrated or unitary structure with the vane 20 secured to and vertically movable with a vertically elongated rectangular column housing. This column housing extends from the upper end of the divider vane 20 whereat open windows 75 (FIG. 8) on opposite sides thereof permit entry of the product half-charges into the column passages 72 and 74, to the lower end of the vane 20 at the fill station 18. As shown in FIG. 2, the combined column 16 and divider vane 20 extend vertically through the film-forming shroud 34, and further through the rectangular outer guide sleeve 17 which extends between the drive belt units 36 of the pull-down mechanism. The divider vane 20 thus cooperates with the column 16 to define the separated column passages 72, 74 which continue uninterrupted into the partially formed bag 14A at the fill station 18. Products free-falling through these column passages 72, 74 tend to orient vertically in the course of passage through the column, such that the products land end-first within the bag on opposite sides of the divider vane 20. The narrow cross sectional width of the passages 72, 74, in combination with the elongated passage length dimension in a horizontal plane, encourages the products within the bag to fall over with a substantial product alignment oriented to extend in parallel aligned array with the longitudinal dimension of the bag in the horizontal plane. The product alignment is enhanced significantly by using the vane 20 to subdivide the bag interior into two separate volumes, in combination with stream-out distribution of the products as they are delivered to the vertical column 16.

As shown in FIG. 8, a lower edge of the divider vane 20 protrudes a short distance beyond the lowermost end of the vertical column 16 at the fill station 18. With this construction, the protruding lower edge of the divider vane 20 assists in retaining the shape of a partially formed bag 14A at the fill station 18 and in the course of bag movement to the underlying settling station 22. In this regard, the divider vane 20 and the column 16 carried thereon are associated with a vertical actuator 78 (FIG. 1) disposed at an upper end of the divider vane 20 for displacing these components through predetermined vertical strokes, whereby the divider vane 20 and the vertical column 16 move as a unit to transport the bag 14A from the fill station 18 to the settling station 22. In addition, a plurality of vacuum ports 80 are formed to extend longitudinally through the divider vane 20, with said vacuum ports 80 terminating in flow communication with a tubular manifold pipe 82 at an upper end of the divider vane. The manifold pipe 82 is adapted for connection through a valve 83 to a suitable vacuum source 84 (FIG. 1). If desired, the valve 83 may also be used to couple the vane vacuum ports 80 to a source 85 of a flush gas under positive pressure, such as nitrogen gas.

Figure 10:
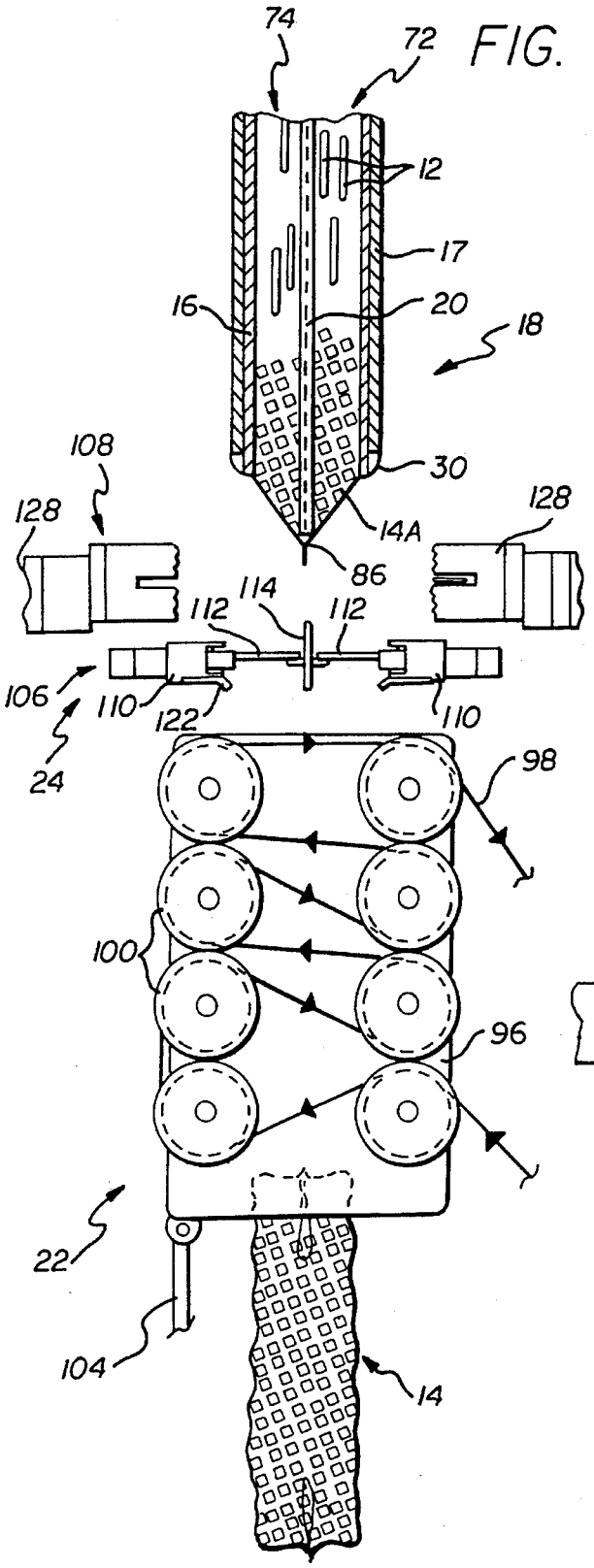
FIGS. 10 is a fragmented vertical sectional view, taken generally on the line 10—10 of FIG. 2, and illustrating an initial bag filling step in accordance with operation of the packaging machine.
Figure 11:
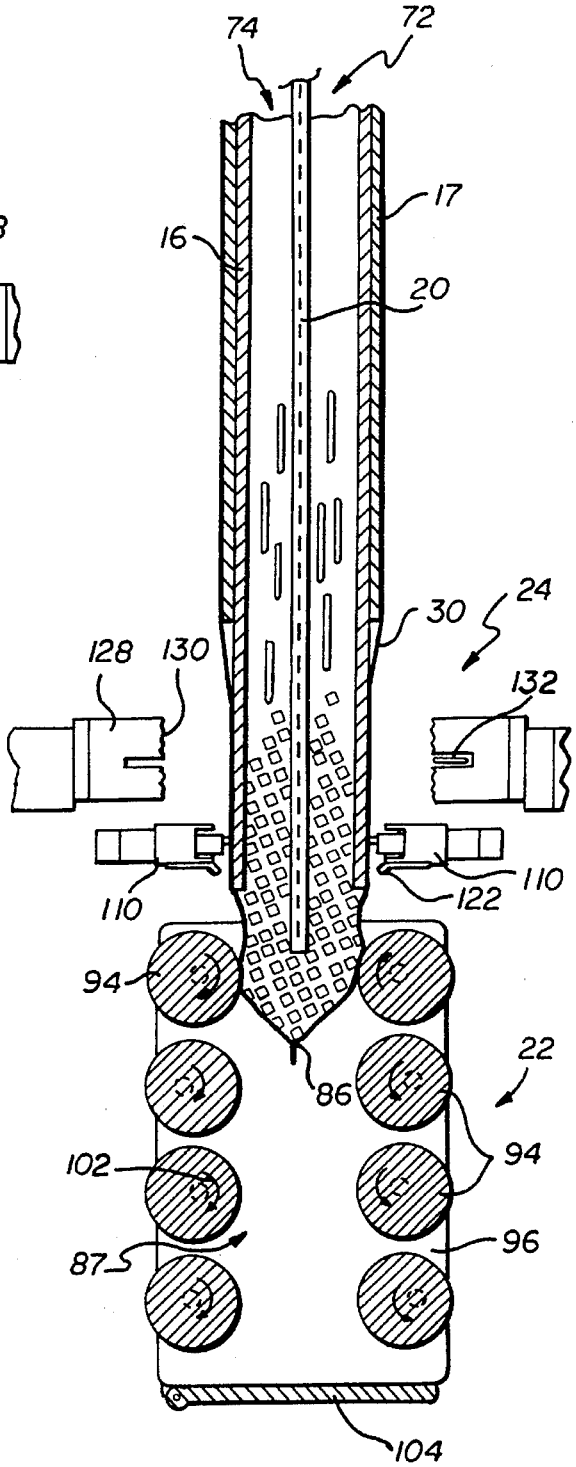
FIG. 11 is a fragmented vertical sectional view similar to FIG. 10, and showing bag transfer during filling thereof to a settling station.

FIG. 10 shows the partially formed bag 14A at the fill station 18, with product strips 12 falling into the bag with substantial product alignment within the narrow column passages 72, 74 at opposite sides of the divider vane 20. In this position, the lower end of the partially formed bag 14A is closed by a seam 86 formed previously by operation of the seal jaw assembly 24. As the bag 14A is filled with the product strips, the bag film material is advanced downwardly by the drive belt units 36 (FIG. 1) concurrently with downward displacement of the divider vane 20 and the rectangular column 16 in response to operation of the vertical actuator 78, as illustrated in FIG. 11. The downwardly displaced bag is transported through the now-open seal jaw assembly 24 and into a generally rectangular chamber 87 at the settling station 22. Downward motion of the divider vane 20 terminates when the vane reaches a position extending a short distance into the volume of the chamber 87, although downward advancement of the bag continues. The timing sequence associated with this step is selected to achieve relative withdrawal or retraction of the divider vane 20 from the interior of the transported bag, while retaining the lower marginal edge of the divider vane 20 below any unoccupied bag volume until the bag is filled with the product charges. The divider vane 20 and column 16 are then retracted upwardly through a partial stroke to an intermediate position, as viewed in FIG. 13.

In accordance with one aspect of the invention, the downward displacement of the bag material 30 occurs upon appropriate inward displacement of the drive belt units 36 in response to operation of actuators 88 (FIG. 1) and drive displacement of the belts. As shown best in FIG. 12, the drive belts 36 are adapted to bear upon the opposite ends of the outer column housing 17 to drive the bag film material 30. In the preferred form, the column housing 17 conveniently includes plenum chambers 90 supplied by a perforated conduit 91 with air under pressure, wherein the pressurized air bleeds outwardly from the plenum chamber 90 through a porous plate 92 to provide an air bearing for the film material 30. This air bearing arrangement facilitates low friction resistance to downward drive advancement of the bag film material, while providing positive frictional drive engagement between the drive belt units 36 and the film material.

As shown in FIGS. 10 and 11, the settling station 22 includes vibratory means for further settled alignment of the product strips 12 before bag closure and sealing. The preferred vibratory means comprises a plurality of eccentric rollers 94 disposed in vertically spaced relation at opposite sides of the settling chamber 87, to extend between supporting end walls 96. The rollers 94 are driven from a motor 97 (FIG. 1) by a common drive belt 98 engaging end-mounted drive pulleys 100 (FIG. 10). The drive belt 98 rotates the rollers 94 to provide an overall downward draw action to the incoming bag as depicted by arrows 102 in. FIG. 11. Moreover, the rollers 94 are mounted on eccentric axes (FIG. 11) to provide a vigorous vibratory in-out action to the bag. In the preferred form, the vertically stacked rollers are oriented about 180° out of phase to provide an alternating or pulsating in-out action to each bag. In addition, the bottom of the settling chamber 87 is upwardly closed by a vibrator plate 104 driven reciprocally to impart a further settling action to the bag contents.

Figure 13:
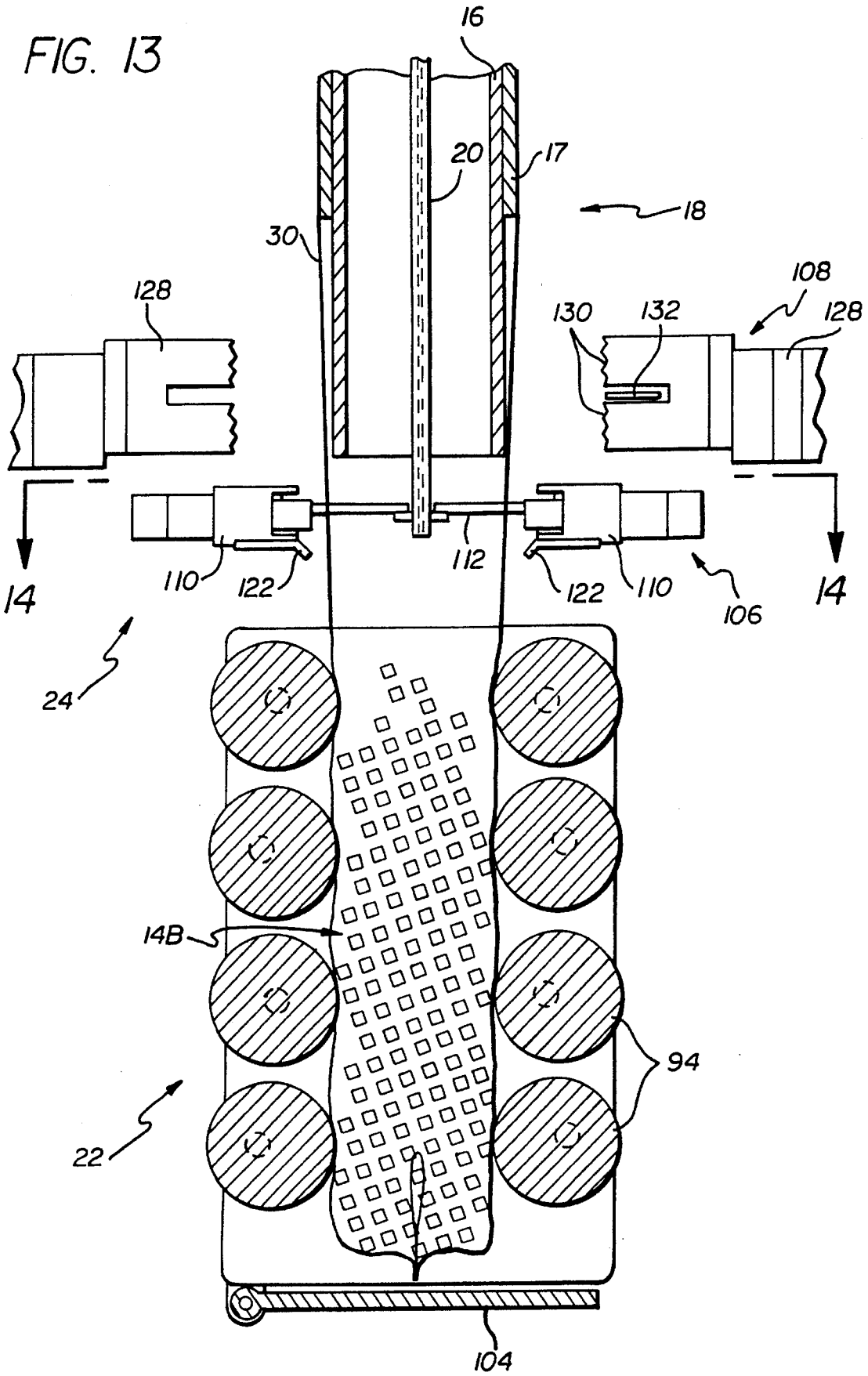
FIG. 13 is an enlarged fragmented vertical sectional view similar to FIG. 11, and illustrating product settling within a filled bag at the settling station.
Figure 15:
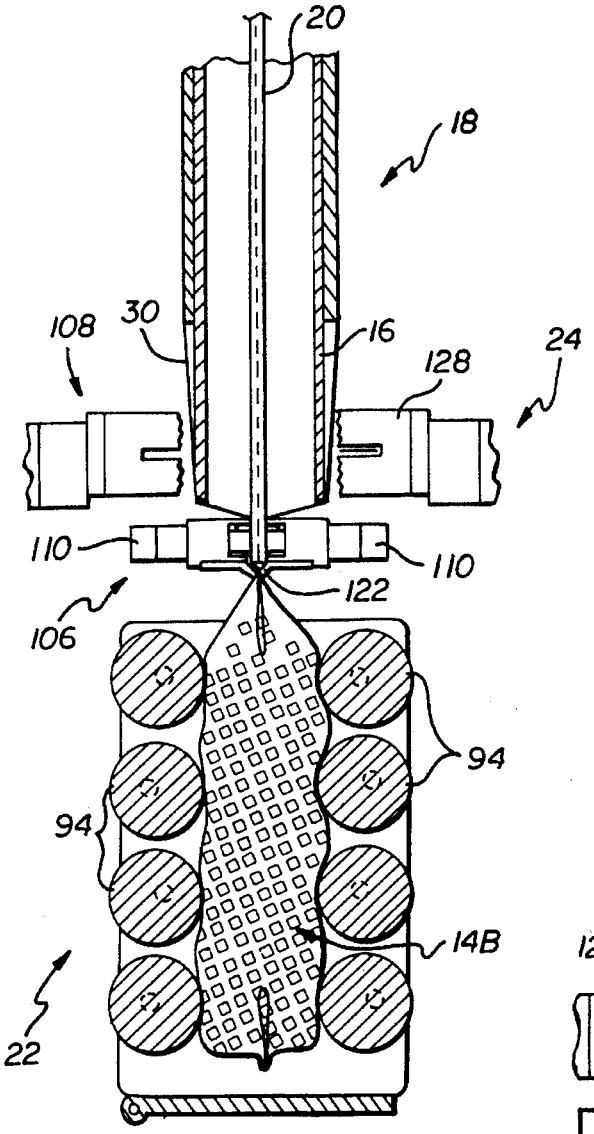
FIG. 15 is a fragmented vertical sectional view similar to FIG. 13, and showing closure of a soft jaw unit to close the top of the filled bag at the settling station.

With reference to FIG. 13, the seal jaw assembly 24 comprises a soft jaw stripper unit 106 and a seal unit 108. The stripper and seal units 106 and 108 are separately actuated as referenced by actuators 109 in FIG. 1 to close upon and engage the bag film material 30 at a location between the overlying fill station 18 and the underlying settling station 22.

More specifically, as shown in FIGS. 13–17, the stripper unit 106 comprises a pair of soft jaw members 110 disposed normally in an open, spaced-apart relation between the overlying seal unit 108 and the underlying settling station 22. The open soft jaw members 110 permit unobstructed downward displacement of a bag concurrently with the divider vane 20 and the lower end of the vertical column 16 during a bag filling step, as described previously. The divider vane 20 and column 16 then retract upwardly to the intermediate position shown in FIG. 13, with the lower edge of the divider vane 20 disposed between the soft jaw members 110. The soft jaw members 110 are then actuated to displace toward each other, into clamping relation with the divider vane 20, as shown in FIGS. 15–18.

The opposite ends of the soft jaw members 110 are connected by pivot links 112 (FIGS. 14 and 17) to a pair of gusset blades 114. The pivot links 112 are arranged so that the gusset blades 114 advance inwardly toward the ends of the bag, when the soft jaw members 110 are closed. As viewed in FIGS. 14 and 17, the gusset blades 114 engage the bag film material 30 and re-shape the film material to define a folded gusset 116 (FIG. 17) as each gusset blade 114 moves toward contact with the adjacent end of the divider vane 20. In this regard, as shown in FIGS. 2 and 8, the opposite ends of the divider vane 20 are relieved or inset by short distances to accommodate gusset blade displacement.

Figure 16:
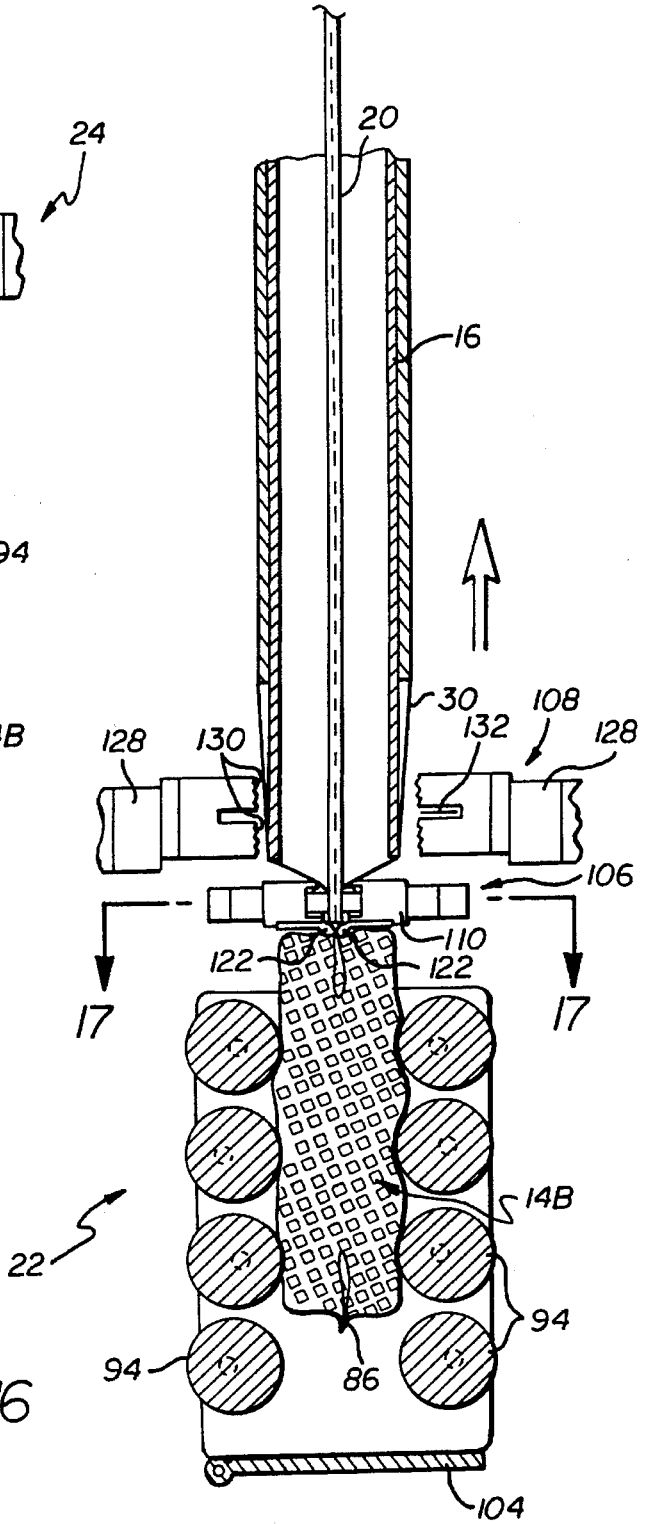
FIG. 16 is a fragmented vertical sectional view similar to FIG. 15 and showing upward retraction of the bag-forming film material to strip and shape the upper end of the filled bag at the settling station.

As shown in FIG. 16, subsequent to closure of the soft jaw members 110, the bag film material 30 is retracted upwardly through a short stroke to square off the upper end of the filled bag 14B at the settling station 22, and additionally to strip any product strips 12 from the vicinity of the closure seal to be formed at the top of the filled bag. Upward movement of the bag film material is achieved by short upward displacement of the forming shroud 34, shown in FIG. 2 to be mounted on a support platform 118 for translation upon activation of an actuator 120. The film material is thus pulled upwardly through the closed soft jaw members 110, which include resilient pinch strips 122 (FIG. 16). The pinch strips 122 function to force any stray french fry strips 12 into packed alignment with other product strips at the top of the filled bag, while squaring off the top region of the bag, as shown. As a result, substantially optimized product bulk density is achieved in a filled bag of highly consistent shape. During this upward film material to displacement, the gussets 116 (FIG. 17) are effectively elongated as the film material is drawn past the gusset blades 114, whereby the gussets 116 extend continuously from the upper region of the underlying filled bag 14B, to a lower region of the next bag 14A in succession.

FIG. 18 shows further features of the soft jaw members 110, for purposes of sealing against the lower end of the divider vane 20 and the gusset blades 114 subsequent to stripping and squaring of the filled bag, as described above. More specifically, the inboard face of each soft jaw member 110 is defined by one wall of a resilient flexible bladder 124. The bladders of the two soft jaw members 110 are inflated via a suitable air source 126 to effectively bind or seal against the divider vane 20 and the adjacent gusset blades 114. A control valve 127 operated by the controller 56 regulates supply of pressurized air to and bleed-off from the bladders 124.

Figure 22:
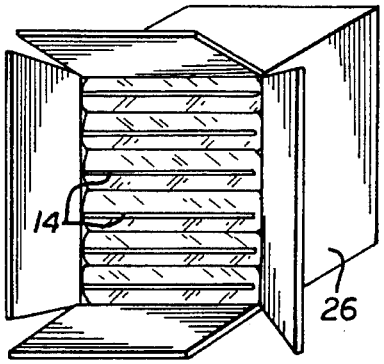
FIG. 22 is a perspective view illustrating a plurality of the vacuum packed bags as depicted in FIG. 21 installed within a rigid shipping case.
Figure 19:
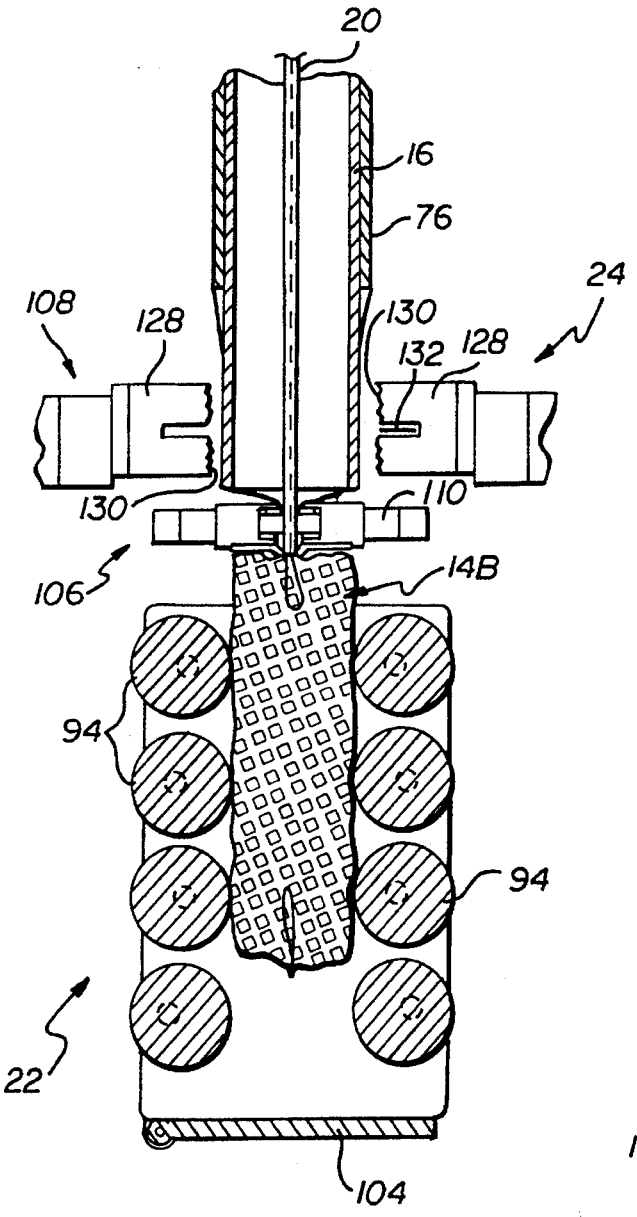
FIG. 19 is a fragmented vertical sectional view similar to FIG. 16 illustrating drawing of a vacuum within the filled bag.
Figure 20:
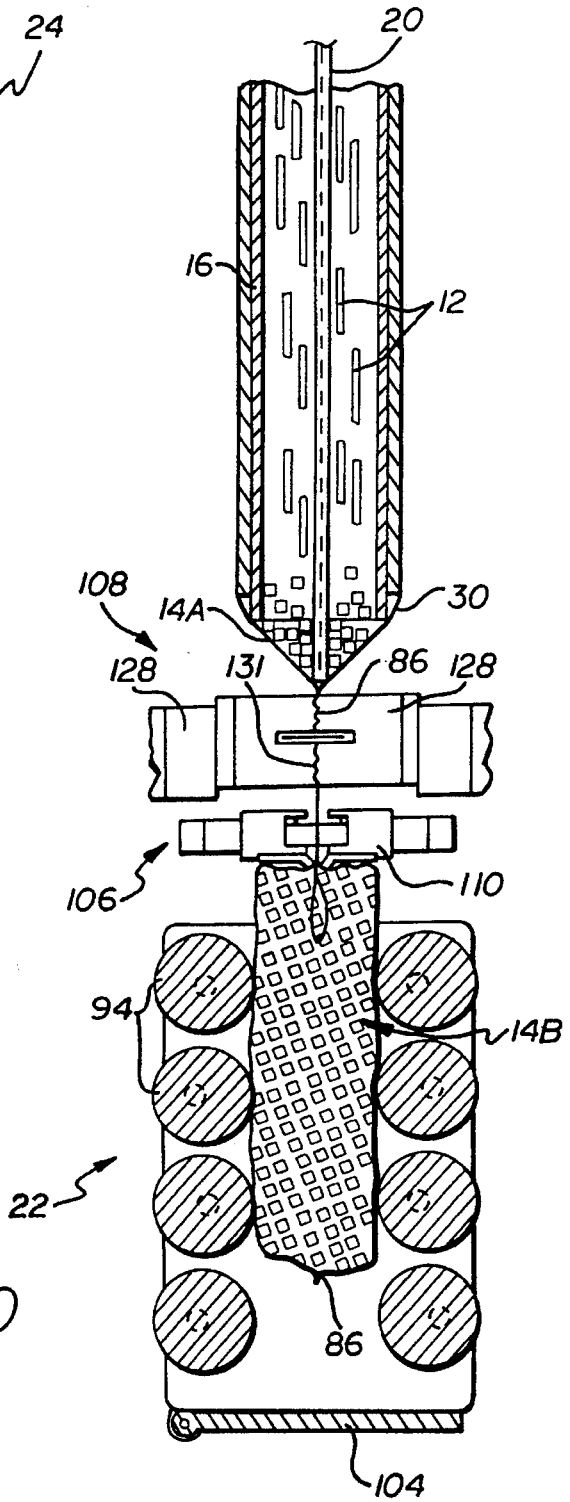
FIG. 20 is a fragmented vertical sectional view similar to FIG. 19, and showing closure of a seal unit to close and seal the upper end of the filled bag, and further to close and seal the lower end of the next bag in succession.

The vacuum source 84 is then activated to draw a vacuum through the divider vane vacuum ports 80, thereby drawing a substantial vacuum within the interior of the filled bag 14B at the settling station 22 (FIG. 19). The vacuum is communicated to the bag interior by virtue of the divider vane lower edge protruding through the closed soft jaw members 110. In the preferred form, the vacuum ports 80 span the length of the divider vane edge, whereby the vacuum ports communicated with the bag interior along virtually the entire top edge thereof. When this substantial vacuum is drawn, a pair of seal jaw members 128 of the seal unit 108 are actuated to close against the bag film material at a position immediately overlying the soft jaw members 110, while the divider vane 20 is retracted upwardly to its initial position viewed in FIGS. 10 and 20. The seal jaw member 128 includes heat seal means 130 for forming a seam 131 sealing the upper end of the filled bag at the settling station 22, in addition to the seam 86 at the lower end of the next bag 14A at the fill station 18. A knife member 132 then severs these two bags 14A, 14B from each other. The vibratory action imparted to the filled bag within the settling chamber 87 is effective to discharge the severed bag 14 past the now-open lower vibratory plate 104. The final evacuated bag 14 is delivered to an appropriate conveyor apparatus (not shown) or the like for further handling, for example, by placement in a group into a cardboard shipping case 26 or the like as shown in FIG. 22.

If desired, this vacuum draw step may be preceded by a gas flush step wherein the vane vacuum ports 80 are initially coupled by the valve 83 to the flush gas source 85, such as nitrogen gas. The gas flush step may occur, for example, concurrently with filling of each bag with product strips, thereby displacing lighter air with heavier nitrogen gas. Thereafter, drawing of the vacuum in each bag effectively insures a minimum oxygen content within each bag and thereby promotes improved product shelf life while retaining freshness characteristics.

The vacuum packed bags beneficially have a rigid configuration attributable to the vacuum drawn therein, together with a substantial uniformity of bag size and shape. A succession of the vacuum sealed bags may thus be packed into shipping cases or cartons in a manner which substantially maximizes available storage and/or shipping space. Unoccupied package volume is substantially eliminated. Moreover, the vacuum sealed bags maintain the aligned products in a substantially rigid configuration to reduce opportunity for product breakage in the course of shipping and handling. Still further, the sealed packaging material may be fully recyclable, and further protects the products against contact with air and associated ice crystal build-up and damage during prolonged storage periods.

A variety of modifications and improvements to the improved vacuum packed machine of the present invention will be apparent to those skilled in the art. Accordingly, no limitation on the invention is intended by way of the foregoing description and accompanying drawings, except as set forth in the appended claims.

What is claimed is:

1. A machine for packaging elongated product strips, said machine comprising:

a vertical free-fall column having open upper and lower ends, and at least one internal divider vane extending through said column to subdivide the column interior into a plurality of column passages each having a vertically open area with a relatively narrow width and a comparatively long length in a horizontal plane;

means for positioning an upwardly open product package in the form of a flexible bag at the lower end of said column, said product package having a cross sectional size and shape conforming generally with the cross sectional size and shape of said column;

means for supplying product strips to the upper end of said column for free-fall through said column passages and into the product package at said lower end of said column, whereby the product strips orient during free-fall through said column passages to fill the product package in a substantially aligned array;

means for drawing a substantial vacuum within the package subsequent to filling thereof with product strips, said vacuum drawing means including a vacuum source and at least one vacuum port formed through said divider vane for communicating said vacuum source with the package interior; and means for closing and sealing the package to maintain the vacuum therein.

2. The machine of claim 1 wherein said plurality of column passages are oriented with the lengths thereof generally in parallel relation.

3. The machine of claim 2 wherein said at least one divider vane subdivides the column interior into a pair of column passages.

4. The machine of claim 2 wherein said column passages have a substantially uniform cross sectional size and shape.

5. The machine of claim 1 wherein said at least one divider vane extends vertically into the interior of the upwardly open package positioned at the lower end of said column, whereby said column passages extend into the package interior, and further including means for separating said package from the lower end of said column upon filling of said package with product strips.

6. The machine of claim 1 wherein said package positioning means comprises means for positioning a succession of product packages at the lower end of said column.

7. The machine of claim 1 further including means for settling the product strips within said bag.

8. The machine of claim 7 wherein said settling means includes vibratory means for settling product strips within said bag prior to closing and sealing thereof.

9. The machine of claim 8 wherein said settling means further includes means for squaring off at least the upper end of said bag prior to closing and sealing thereof.

10. The machine of claim 8 wherein said settling means includes means for squaring off upper and lower ends of said bag prior to closing and sealing thereof.

11. The machine of claim 1 further including means for supplying a flush gas to the bag interior prior to drawing said vacuum.

12. The machine of claim 1 wherein said product strip supplying means includes means for supplying product strip charges of predetermined amounts individually to each of said column passages.

13. The machine of claim 12 wherein said product strip supplying means includes a plurality of stream-out chutes associated respectively with said column passages for providing an elongated flow stream of product strips substantially without strip clustering to each of said column passages.

14. The machine of claim 12 wherein each of said stream-out chutes has a generally spiral configuration defining at least two vertically offset turns.

15. The machine of claim 12 wherein said product strip supplying means further includes distribution means for substantially uniformly distributing each product trip charge across the vertically open area of the column passage associated therewith.

16. The machine of claim 1 wherein said column has a vertical length of at least about twenty inches.

17. A machine for packing elongated product strips, said machine comprising:

a vertical free-fall column having open upper and lower ends, and at least one internal divider vane extending through said column to subdivide said column into a plurality of column passages of generally uniform and generally rectangular cross section each having a relatively narrow width and a comparatively long length in a horizontal plane, said column passages being oriented with the lengths thereof in generally parallel relation;

means for supplying product strips to the upper end of said column in a plurality of strip charges of predetermined and substantially uniform amounts for free-fall of said strip charges respectively through said column passages;

means for positioning a succession of upwardly open product packages in the form of flexible bags at the lower end of said column for filling thereof with said strip charges;

each of said bags cooperating with the lower end of said column to define a bag fill station whereby the product strips free-fall through said column passage to fill the bag at said fill station;

a settling station below said fill station;

means for transferring each bag in succession from said fill station to said settling station, said settling station including means for substantially retaining the shape of the filled bag transferred thereto;

vacuum means for drawing a vacuum within the bag at said settling station, said vacuum means including a vacuum source and at least one vacuum port formed through said divider vane for communicating said vacuum source with the bag interior; and seal means to close and seal the bag at said settling station while retaining the vacuum drawn therein.

18. The machine of claim 17 wherein said at least one divider vane extends vertically into the interior of the upwardly open package positioned at the lower end of said column, whereby said column passages extend into the package interior, and further including means for separating said package from the lower end of said column upon filling of said package with product strips.

19. A machine for packing elongated product strips, said machine comprising:

a vertical free-fall column having open upper and lower ends, and at least one internal divider vane extending through said column to subdivide said column into a plurality of column passages of generally uniform and generally rectangular cross section each having a relatively narrow width and a comparatively long length in a horizontal plane, said column passages being oriented with the lengths thereof in generally parallel relation; and means for supplying product strips to the upper end of said column in a plurality of strip charges of predetermined and substantially uniform amounts for free-fall of said strip charges respectively through said column passages;

means for supplying a succession of upwardly open flexible bags formed from an air impervious bag film material to a position generally at the lower end of said column for filling of each of said bags with the strip charges falling through said column;

means for drawing a vacuum within each of said bags subsequent to filling thereof, said vacuum drawing means including a vacuum source coupled to the interior of each filled bag and at least one vacuum port formed in said divider vane; and means for sealing an upper end portion of each filled bag subsequent to drawing of the vacuum therein.

20. The machine of claim 19 wherein said bag supplying means comprises means for supplying a length of the bag film material in wrapped relation about said column, with opposite marginal edges of the film material generally overlapping, means for longitudinally seaming said overlapping marginal edges to form said film material into a closed loop cross sectional shape about said column, and means for displacing said film material downwardly about said column.

21. The machine of claim 20 wherein said sealing means comprises a seal jaw assembly having a pair of seal jaws for closing upon the film material at a position below said column lower end to close and seal an upper end of each filled bag and further to close and seal a lower end of the next bag in succession, and knife means for severing each filled bag from the next bag in succession.

22. The machine of claim 21 further including a settling station defining a settling chamber for receiving each filled bag at a position below said column lower end and below said seal jaw assembly, said settling station including means for settling product strips within each filled bag prior to closing and sealing of the upper end thereof.

23. The machine of claim 22 further including means for squaring off at least the upper end of each filled bag within said settling chamber prior to closing and sealing thereof.

24. The machine of claim 22 further including means for squaring off upper and lower ends of each filled bag within said settling chamber prior to closing and sealing thereof.

25. The machine of claim 19 further including means for supplying a flush gas through said at least one vacuum port to the bag interior prior to drawing said vacuum.

26. A machine for packing elongated product strips, said machine comprising:

a vertical free-fall column having open upper and lower ends, and a central divider vane extending through said column to subdivide the interior thereof into a separated pair of column passages each having a generally rectangular cross sectional shape with a relatively narrow width dimension and a comparatively substantially longer length dimension in a horizontal plane, said column passages being oriented with their length dimensions generally in parallel relation;

means for supplying an elongated bag-forming film material in wrapped relation about said column with generally overlapping side marginal edges;

means for advancing the film material downwardly generally about said column;

means for longitudinally seaming said film material generally at said side marginal edges to form said film material into a closed loop cross sectional shape;

seal means for closing and sealing said film material at a position spaced a short distance below said column, thereby defining a partially formed and upwardly open bag disposed at said column lower end in open communication with said column passages, said partially formed bag and said column lower end cooperatively defining a bag fill station approximating the desired size and shape of a filled bag; and means for supplying product strip charges in predetermined amounts respectively to said column passages at the upper end of said column, whereby said product strip charges free-fall through said column passages and orient substantially during said free-fall to fill said partially formed bag at said fill station in substantially aligned array and with a bag size and shape generally conforming to the desired size and shape of a filled bag;

a settling station disposed below said fill station;

said film material advancing means being effective to advance the film material downwardly about said column to displace a filled partially formed bag downwardly from said fill station to said settling station, said settling station including means for substantially retaining the shape of the filled bag advanced thereto from said fill station;

vacuum means for drawing a vacuum within the bag at said settling station, said vacuum means including a vacuum source and at least one vacuum port formed through said divider vane for communicating said vacuum source to the bag at said settling station to draw a vacuum therein;

said seal means being effective to close and seal an upper end of a filled bag subsequent to downward transport thereof from said fill station to said settling station and drawing of the vacuum therein, and further to close and seal a lower end of a successive bag located at said fill station;

said seal means further including cutter means for severing the film material to separate the upper end of a filled bag at said settling station from the lower end of a successive bag at said fill station.

27. The machine of claim 26 wherein said column passages have a uniform cross sectional size and shape, and further wherein said means for supplying the product strip charges provides said charges in predetermined, substantially equal weights.

28. The machine of claim 27 wherein said product strip supplying means includes a plurality of stream-out chutes associated respectively with said column passages for providing an elongated flow stream of product strips substantially without strip clustering to each of said column passages.

29. The machine of claim 28 wherein each of said stream-out chutes has a generally spiral configuration defining at least two vertically offset turns.

30. The machine of claim 27 wherein said product strip supplying means further includes distribution means for substantially uniformly distributing each product strip charge across the vertically open area of the column passage associated therewith.

31. The machine of claim 30 wherein said distribution means comprises a distribution funnel defining a generally rectangular funnel opening disposed generally over a respective one of said column passages, said distribution funnel including at least one convexly curved deflector wall segment for distributing a product charge incident thereon with substantial uniformity across the open area of said funnel opening.

32. The machine of claim 27 further including a plurality of weigh buckets associated with each of said column passages and having product strips supplied thereto, and control means for dumping product strips from selected ones of said weigh buckets to define the product charge supplied to said column passage associated therewith.

33. The machine of claim 26 wherein said divider vane extends at least part-way into said partially formed bag at said fill station during filling of said bag with the product strips.

34. The machine of claim 33 including means for displacing said divider vane downwardly through a short stroke upon downward movement of the partially formed bag from said fill station.

35. The machine of claim 32 wherein said lower end of said column extends at least part-way into said partially formed bag at said fill station during filling of said bag with the product strips.

36. The machine of claim 35 including means for displacing said divider vane and said vertical column downwardly through a short stroke upon downward movement of the partially formed bag from said filling station.

37. The machine of claim 26 wherein said seal means further includes means for forming gussets at the upper end of a filled bag and at the lower end of the successive bag upon respective closure of the upper and lower ends thereof.

38. The machine of claim 26 wherein said seal means further includes means for closing the film material against a lower edge of said divider vane, with said divider vane lower edge protruding into the upper end of a filled bag subsequent to downward transport thereof from said fill station, and means for relatively withdrawing said divider vane lower edge from said filled bag subsequent to drawing said vacuum, said seal means maintaining said filled bag substantially closed and sealed with said vacuum retained therein upon sealing of said filled bag upper end.

39. The machine of claim 38 wherein said divider vane has a plurality of vacuum ports formed therein to communicate with the upper end of the filled bag substantially along the length of said bag upper end.

40. The machine of claim 38 wherein said seal means includes inflatable members for sealingly closing the film material against said divider vane lower edge, and means for inflating said inflatable members.

41. The machine of claim 38 further including means for retracting the film material upwardly about said column through a short stroke subsequent to closure of said seal means against said divider vane lower edge and prior to drawing of said vacuum, said film material retracting step being effective to pull the upper end of said filled bag against said seal means to square off the bag shape at the upper end thereof.

42. The machine of claim 26 further including means for retracting the film material upwardly about said column through a short stroke subsequent to closure of said seal means and prior to sealing and severing of the bag film material, said film material retracting step being effective to pull the upper end of said filled bag against said seal means to square off the bag shape at the upper end thereof.

43. The machine of claim 26 wherein said settling station further includes means for settling product strips within the filled bag prior to sealing of the bag upper end.

44. The machine of claim 43 further including means for squaring off at least the upper end of each filled bag at said settling station.

45. The machine of claim 43 further including means for squaring off upper and lower ends of each filled bag at said settling station.

46. The machine of claim 43 wherein said settling means comprises a plurality of rollers disposed on opposite sides of said settling chamber.

47. The machine of claim 46 wherein said settling means further includes a vibrator plate disposed at a lower end of said settling chamber, and actuator means for vibrating said plate against a lower end of a filled bag prior to closure and sealing thereof, and for moving said plate to an out-of-the-way position when said filled bag is severed from the film material to permit the filled bag to fall from said settling chamber.

48. The machine of claim 46 wherein said rollers are driven in a direction to assist downward draw of a bag from said fill station.

49. The machine of claim 26 wherein said film material advancing means includes means for engaging and driving the film material disposed about said column, and air bearing means for minimizing friction between said film material and said column.

* * * * *